US012703062B2

(12) United States Patent
Cheng et al.

(10) Patent No.: US 12,703,062 B2
(45) Date of Patent: Aug. 11, 2026

(54) WAFER GRINDING PARAMETER OPTIMIZATION METHOD AND ELECTRONIC DEVICE

(71) Applicant: GlobalWafers Co., Ltd., Hsinchu (TW)

(72) Inventors: Chih-Chun Cheng, Hsinchu (TW); Wen-Nan Cheng, Hsinchu (TW); Meng-Bi Lin, Hsinchu (TW); Chi-Feng Li, Hsinchu (TW); Tzu-Fan Chiang, Hsinchu (TW); Wei-Jen Chen, Hsinchu (TW); Chien Hung Chen, Hsinchu (TW); Hsiu Chi Liang, Hsinchu (TW); Ying-Ru Shih, Hsinchu (TW)

(73) Assignee: GlobalWafers Co., Ltd., Hsinchu (TW)

( * ) Notice: Subject to any disclaimer, the term of this patent is extended or adjusted under 35 U.S.C. 154(b) by 357 days.

(21) Appl. No.: 18/465,181

(22) Filed: Sep. 12, 2023

(65) Prior Publication Data

US 2024/0173819 A1 May 30, 2024

(30) Foreign Application Priority Data

Nov. 29, 2022 (TW) ..... 111145714

(51) Int. Cl.
*B24B 51/00* (2006.01)
*B24B 7/22* (2006.01)

(52) U.S. Cl.
CPC ..... *B24B 51/00* (2013.01); *B24B 7/228* (2013.01)

(58) Field of Classification Search
None
See application file for complete search history.

(56) References Cited

U.S. PATENT DOCUMENTS 4,604,834 A 8/1986 Thompson
2014/0373884 A1* 12/2014 Shinozaki ..... H10P 72/0414 269/57

FOREIGN PATENT DOCUMENTS

| | | |
|---|---|---|
| CN | 105549544 | 5/2016 |
| CN | 107756250 | 3/2018 |
| CN | 106396033 | 6/2018 |
| CN | 111716251 | 9/2020 |
| CN | 112440203 | 3/2021 |

(Continued)

OTHER PUBLICATIONS

Jianping Yue, "Creating a Stability Lobe Diagram", 2006 IJME-INTERTECH Conference, Jan. 2006, pp. 1-18.

(Continued)

*Primary Examiner* — Brian D Keller
*Assistant Examiner* — Jason Khalil Hawkins
(74) *Attorney, Agent, or Firm* — JCIPRNET

(57) ABSTRACT

A wafer grinding parameter optimization method and an electronic device are provided. The method includes the following. A natural frequency of a grinding wheel spindle of wafer processing equipment is obtained, and a grinding stability lobe diagram is generated accordingly. A grinding speed is selected based on a speed range of the grinding wheel spindle. Multiple grinding parameter combinations are determined based on the grinding speed. Multiple grinding simulation result combinations corresponding to the grinding parameter combinations are generated. A specific grinding parameter combination is selected based on each of the grinding simulation result combinations, and the wafer processing equipment is set accordingly.

9 Claims, 11 Drawing Sheets

(56) References Cited

FOREIGN PATENT DOCUMENTS

| | | |
|---|---|---|
| CN | 113767343 | 12/2021 |
| CN | 114161240 | 3/2022 |
| CN | 114227461 | 3/2022 |
| CN | 114536108 | 5/2022 |
| CN | 114714157 | 7/2022 |
| CN | 115091287 | 9/2022 |
| CN | 115397612 | 11/2022 |
| TW | I221435 | 10/2004 |
| TW | 200626297 | 8/2006 |
| TW | 201008703 | 3/2010 |

OTHER PUBLICATIONS

Libo Zhoua et al., "Three-dimensional kinematical analyses for surface grinding of large scale substrate", Precision Engineering, Apr. 2003, pp. 175-184.

Ronald Faassen, "Chatter Prediction and Control for High-Speed Milling : modelling and experiments", Phd Thesis of Eindhoven University of Technology, Jun. 2007, pp. 1-158.

"Office Action of China Counterpart Application", issued on Mar. 31, 2026, p. 1-p. 9.

* cited by examiner

WAFER GRINDING PARAMETER OPTIMIZATION METHOD AND ELECTRONIC DEVICE

CROSS-REFERENCE TO RELATED APPLICATION

This application claims the priority benefit of Taiwan application serial no. 111145714, filed on Nov. 29, 2022. The entirety of the above-mentioned patent application is hereby incorporated by reference herein and made a part of this specification.

BACKGROUND

Technical Field

The invention relates to a wafer processing technology, and more particularly, to a wafer grinding parameter optimization method and an electronic device.

Description of Related Art

In known wafer processing methods, a trial and error method is often used to determine related processing parameters, and then a wafer is processed, for example, ground according to the method. After the processing of the wafer is completed, inspection instrument is used to measure accuracy of a wafer surface. This process is not only time-consuming, labor-intensive, and increases consumables, but also difficult to fully demonstrate the effectiveness.

SUMMARY

The invention provides a wafer grinding parameter optimization method and an electronic device, which may be used to solve the above technical issues.

An embodiment of the invention provides a wafer grinding parameter optimization method adapted to an electronic device, and the method includes the following. A natural frequency of a grinding wheel spindle of wafer processing equipment is obtained, and a grinding stability lobe diagram corresponding to the grinding wheel spindle is generated accordingly. At least one grinding speed is selected from the grinding stability lobe diagram based on a speed range of the grinding wheel spindle. Multiple grinding parameter combinations are determined based on the at least one grinding speed. Multiple grinding simulation result combinations corresponding to the grinding parameter combinations are generated. A specific grinding parameter combination is selected from the grinding parameter combinations based on each of the grinding simulation result combinations, and the wafer processing equipment is set accordingly.

An embodiment of the invention provides an electronic device including a storage circuit and a processor. The storage circuit stores a program code. The processor is coupled to the storage circuit and accesses the program code to obtain a natural frequency of a grinding wheel spindle of wafer processing equipment and accordingly generate a grinding stability lobe diagram corresponding to the grinding wheel spindle, select at least one grinding speed from the grinding stability lobe diagram based on a speed range of the grinding wheel spindle, determine multiple grinding parameter combinations based on the at least one grinding speed, generate multiple grinding simulation result combinations corresponding to the grinding parameter combinations, and select a specific grinding parameter combination from the grinding parameter combinations based on each of the grinding simulation result combinations and set the wafer processing equipment accordingly.

DESCRIPTION OF THE EMBODIMENTS

Figure 1:
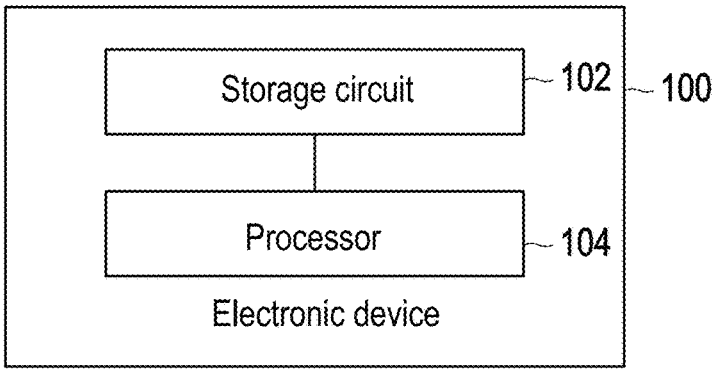
FIG. 1 is a schematic diagram of an electronic device according to an embodiment of the invention.

Referring to FIG. 1, FIG. 1 is a schematic diagram of an electronic device according to an embodiment of the invention. In different embodiments, an electronic device 100 is, for example, various smart devices and/or computer devices. In some embodiments, the electronic device 100 may also be integrated into wafer processing equipment to be used as a processing device/human-machine interface in the wafer processing equipment, but the invention is not limited thereto.

In FIG. 1, the electronic device 100 includes a storage circuit 102 and a processor 104. The storage circuit 102 is, for example, any type of fixed or removable random access memory (RAM), read-only memory (ROM), flash memory, hard disc or other similar device or a combination of these devices, which may be used to record multiple program codes or modules.

The processor 104 is coupled to the storage circuit 102, and may be a general purpose processor, a special purpose processor, a conventional processor, a digital signal processor, multiple microprocessors, one or more microprocessors, controllers, microcontrollers, application specific integrated circuits (ASICs), field programmable gate array circuits (FPGAs) combined with digital signal processor cores, any other kind of integrated circuit, state machine, processor based on advanced RISC machine (ARM), etc.

In an embodiment of the invention, the processor 104 may access modules and program codes recorded in the storage circuit 102 to implement the wafer grinding parameter optimization method provided by the invention, and details thereof are as follows.

Figure 2:
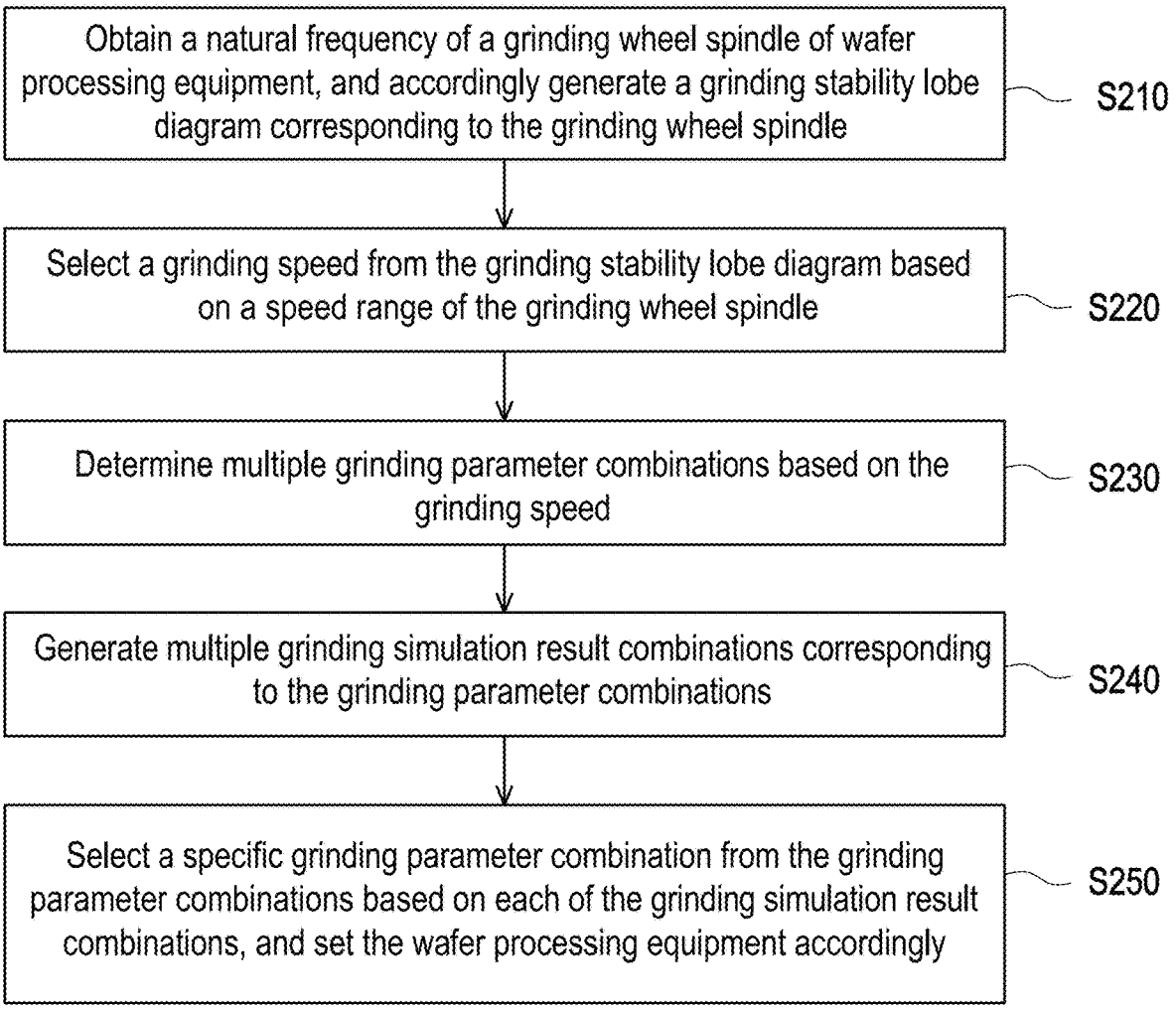
FIG. 2 is a flowchart of a wafer grinding parameter optimization method according to an embodiment of the invention.

Referring to FIG. 2, FIG. 2 is a flowchart of a wafer grinding parameter optimization method according to an embodiment of the invention. The method of the embodiment may be executed by the electronic device 100 in FIG. 1, and the details of each of steps in FIG. 2 will be described below with reference of the components shown in FIG. 1.

First, in step S210, the processor 104 obtains a natural frequency of a grinding wheel spindle of wafer processing equipment, and accordingly generates a grinding stability lobe diagram corresponding to the grinding wheel spindle.

Figure 3:
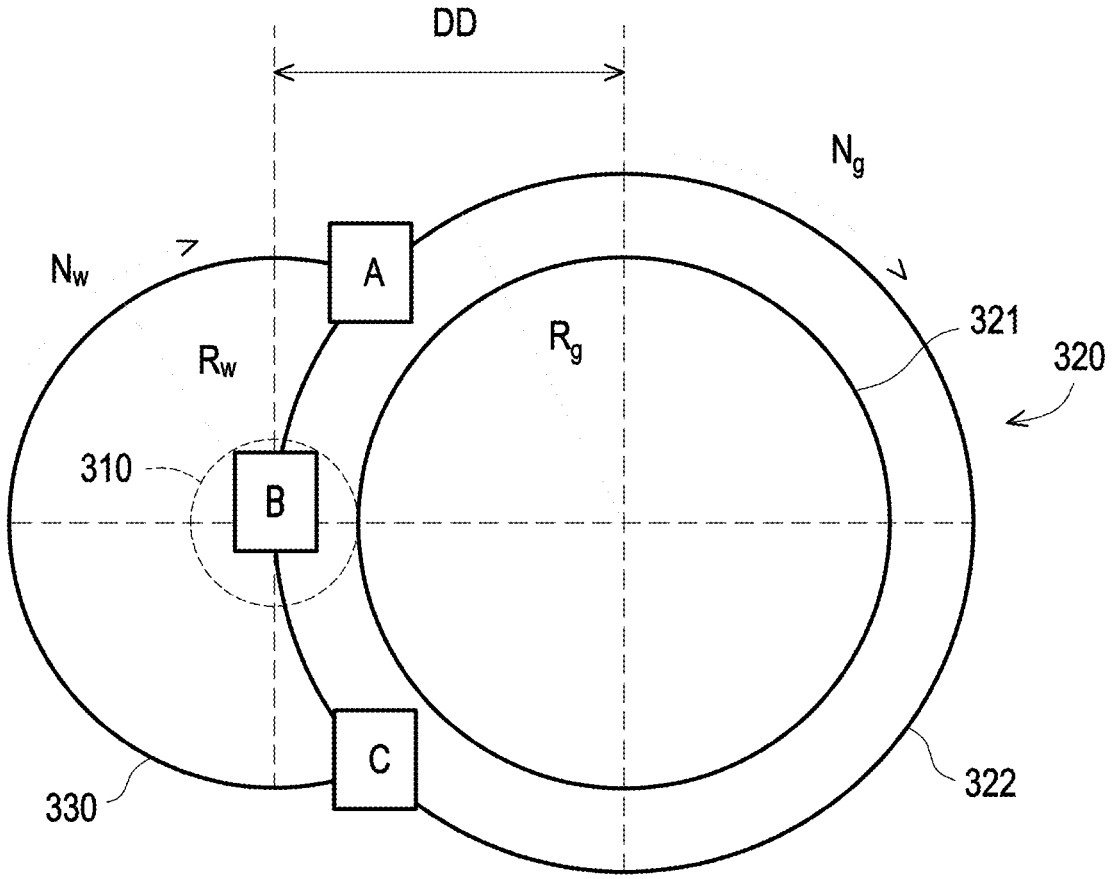
FIG. 3 is a schematic diagram of wafer processing equipment according to an embodiment of the invention.

Referring to FIG. 3, FIG. 3 is a schematic diagram of wafer processing equipment according to an embodiment of the invention. In FIG. 3, wafer processing equipment 300 may include a turntable 310 and a grinding wheel 320. In an embodiment, the turntable 310 may be used to carry a wafer 330 (for example, having a radius $R_w$) to be ground, and rotate at a turntable speed $N_w$, thereby driving the wafer 330 to rotate at the turntable speed $N_w$. The grinding wheel 320 (for example, having a radius $R_g$) may have a spindle 321 and a grinding portion 322, where the spindle 321 may rotate at a grinding speed $N_g$, and the grinding portion 322 may be provided with abrasive grains for grinding the wafer 330.

In some embodiments, the grinding wheel 320 may have reference points A, B, and C, and the operator may set an inclination angle (referred to as AN hereinafter) of the grinding wheel 320 when grinding the wafer 330 by adjusting positions of the reference points A, B, and C. Moreover, the turntable speed $N_w$, the grinding speed $N_g$, a grinding wheel feed rate of the grinding wheel 320 and an eccentric offset DD between the turntable 310 and the spindle 321 may also be set by an operator according to actual requirements. In this way, the wafer processing equipment 300 may perform corresponding grinding processing on the wafer 330 according to the above settings of the operator.

Figure 4A:
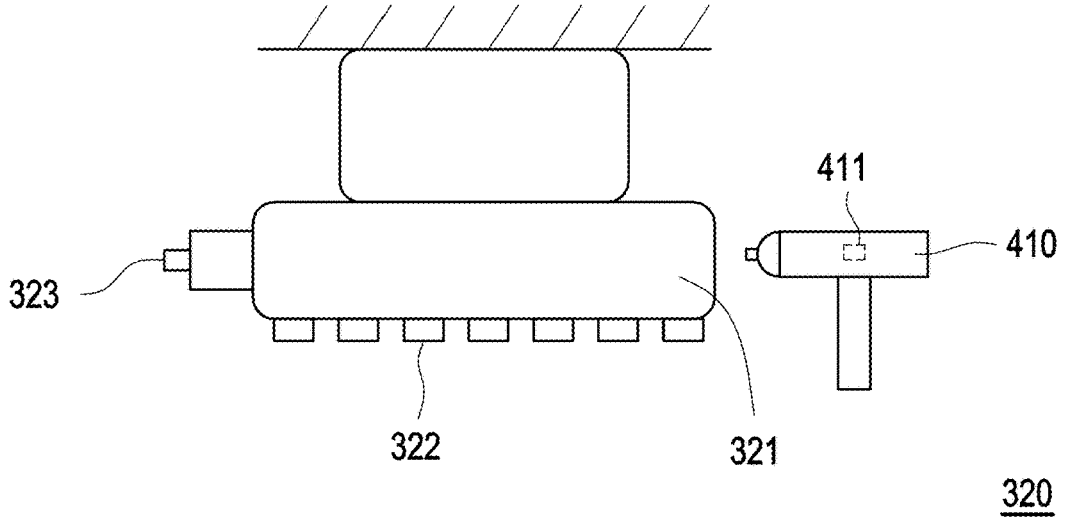
FIG. 4A is a side view of a grinding wheel shown in FIG. 3.

Referring to FIG. 4A, FIG. 4A is a side view of the grinding wheel shown in FIG. 3. In FIG. 4A, an accelerometer 323 may be disposed on the spindle 321 of the grinding wheel 320, which may be used to collect vibration occurred on the spindle 321 and/or a force borne by the spindle 321. In addition, abrasive grains (shown as rectangular blocks) for grinding the wafer 330 may be disposed on the grinding portion 322, but the invention is not limited thereto.

Figure 4B:
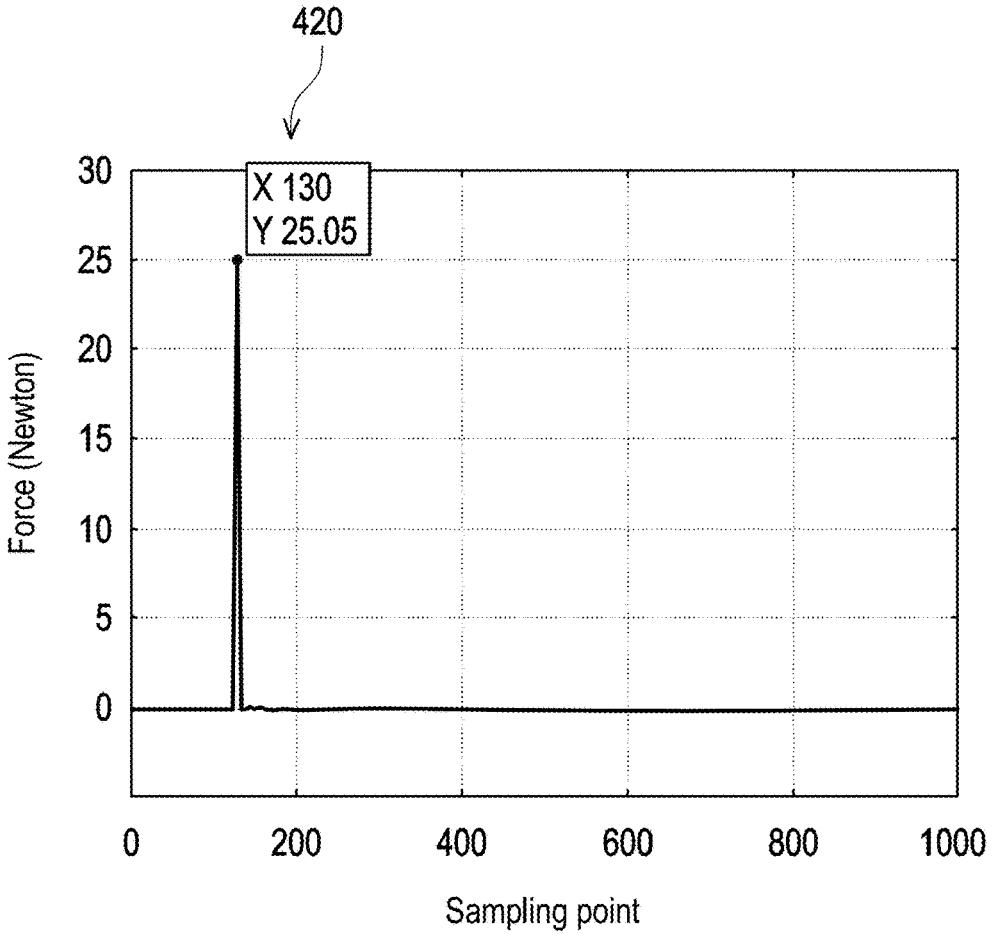
FIG. 4B is a schematic diagram of a force signal in a pulse form according to an embodiment of the invention.
Figure 4C:
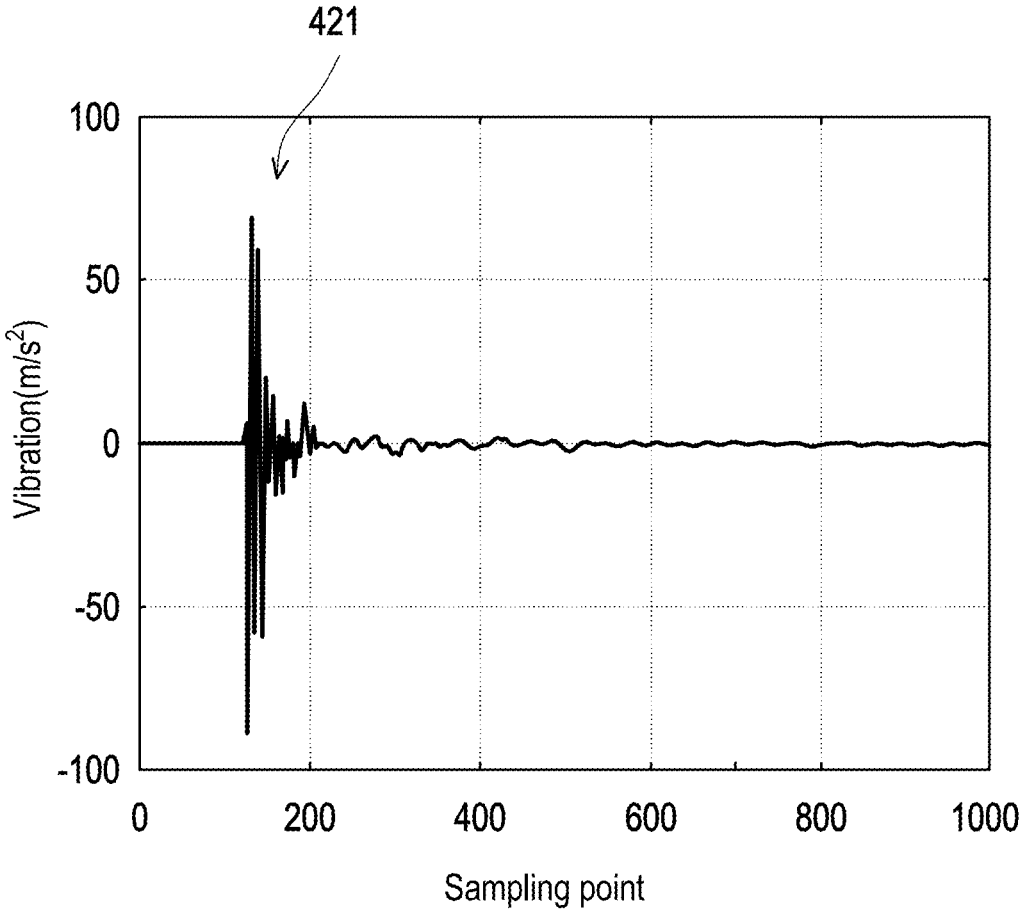
FIG. 4C is a schematic diagram of a vibration signal according to an embodiment of the invention.

In an embodiment, when obtaining the natural frequency of the spindle 321 of the grinding wheel 320, related personnel may use an impact hammer 410 to knock the spindle 321 in a stationary state, so that a force sensor 411 on the impact hammer 410 may collect a force signal 420 presented in a pulse form, as illustrated in FIG. 4B. In addition, a vibration signal 421 collected by the accelerometer 323 in response to the aforementioned knocking is illustrated in FIG. 4C.

Referring to FIG. 4B, FIG. 4B is a schematic diagram of the force signal in the pulse form according to an embodiment of the invention. In FIG. 4B, for example, the force signal 420 with a magnitude of 25.05 Newton measured at a $130^{th}$ sampling point is shown, but the invention is not limited thereto.

After obtaining the force signal 420 and the vibration signal 421, the processor 104 may, for example, convert them into the natural frequency of the spindle 321, and obtain the grinding stability lobe diagram (SLD) of the spindle 321 of the grinding wheel 320 according to the natural frequency.

In an embodiment, the processor 104 may, for example, perform the above-mentioned operations of estimating the natural frequency corresponding to the force signal 420 and obtaining the corresponding grinding stability lobe diagram based on the content of "Yue, Jianping. (2006). Creating a Stability Lobe Diagram. 301-50.", and details thereof will not be repeated here.

Figure 5:
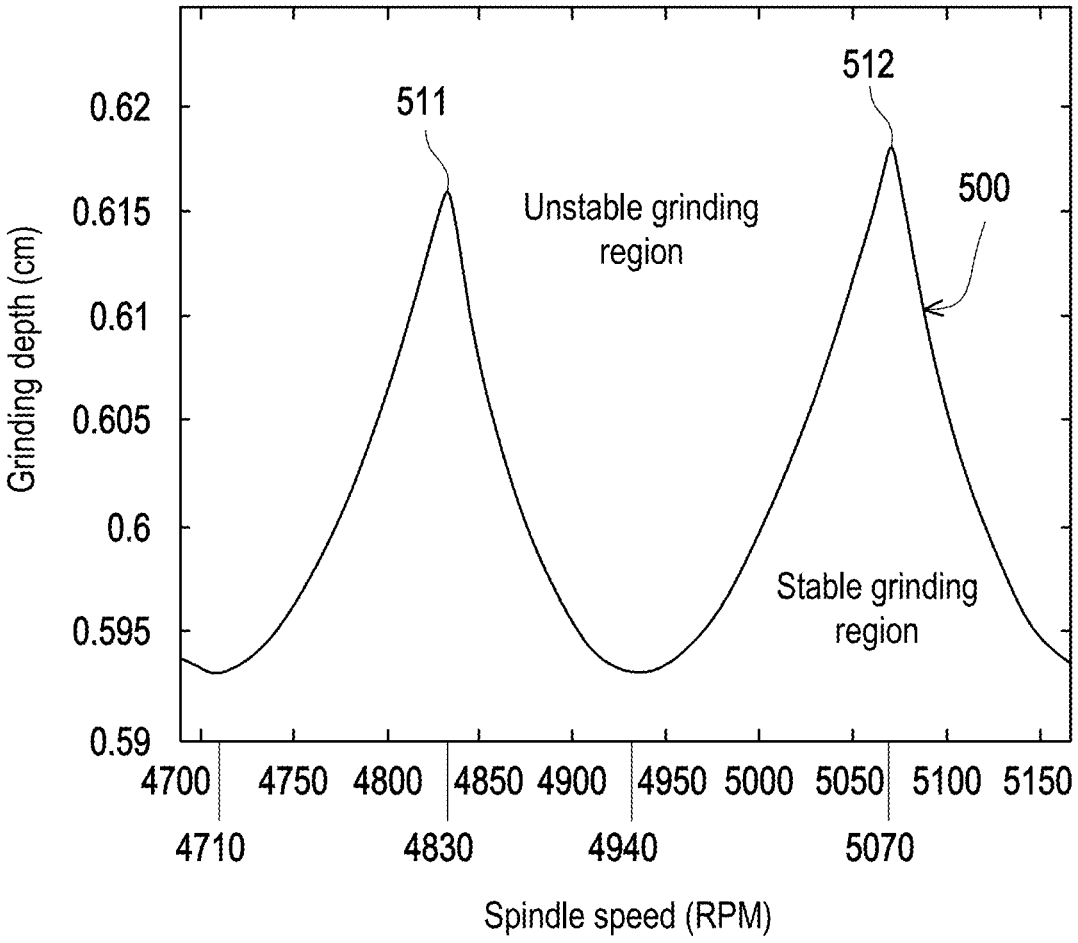
FIG. 5 is a grinding stability lobe diagram according to an embodiment of the invention.

Referring to FIG. 5, FIG. 5 is a grinding stability lobe diagram according to an embodiment of the invention. In the embodiment, it is assumed that a grinding stability lobe diagram 500 in FIG. 5 corresponds to the spindle 321 of FIG. 3, where an upper part of the grinding stability lobe diagram 500 may be referred to as an unstable grinding region, while a lower part of the grinding stability lobe diagram 500 may be referred to as a stable grinding region. It may be seen from FIG. 5 that when a speed of the spindle 321 is within a certain range, the wafer 330 may be ground more stably, and chatter is not easily generated. For example, when the speed of the spindle 321 is about 4830 RPM or 5070 RPM, stably grinding is achieved. In addition, when the speed of the spindle 321 is in a certain range, it is difficult to grind the wafer 330 stably, and chatter is likely to occur. For example, when the speed of the spindle 321 is about 4710 RPM or 4940 RPM, stable grinding may be achieved.

In step S220, the processor 104 selects a grinding speed from the grinding stability lobe diagram 500 based on a speed range of the spindle 321 of the grinding wheel 320.

For example, it is assumed that the speed of the spindle 321 ranges from 4000 to 6000, the processor 104 may, for example, select a speed in the speed range that is less prone to vibration as the grinding speed (i.e., $N_g$) according to FIG. 5, for example, 4800, 4833, 5071 RPM, etc., but the invention is not limited thereto.

In an embodiment, the grinding stability lobe diagram 500 may be understood as including multiple peaks 511 and 512, and the processor 104 may find multiple specific peaks corresponding to the speed range of the spindle 321 from the peaks 511 and 512. Each of the specific peaks corresponds to a specific speed. In FIG. 5, since the peaks 511 and 512 fall within the speed range of the spindle 321, the peaks 511 and 512 may all be regarded as the specific peaks, and their corresponding speeds (such as 4833 and 5071 RPM) may be understood as the corresponding specific speeds. Thereafter, the processor 104 may determine the grinding speed based on the specific speed corresponding to each of the specific peaks. For example, the processor 104 may take both 4833 and 5071 RPM as one of the grinding speeds.

In addition, the processor 104 may also set another speed that differs from any specific speed by less than a preset threshold (such as 50) as one of the grinding speeds. In the situation of FIG. 5, the processor 104 may, for example, set 4800 RPM, which differs from 4833 RPM by less than 50 as one of the grinding speeds, but the invention is not limited thereto.

Thereafter, in step S230, the processor 104 determines multiple grinding parameter combinations based on the grinding speed. In an embodiment of the invention, each of the grinding parameter combinations includes at least one geometric parameter and at least one processing parameter, where the processing parameter includes one of the above grinding speeds.

In an embodiment, the above-mentioned geometric parameters include at least one of the following parameters: a radius $R_g$ of the grinding wheel 320; a radius $R_w$ of the wafer 330; an eccentric distance DD of the grinding wheel 320 relative to the turntable 310; an inclination angle AN of the grinding wheel 320 relative to the turntable 310.

In addition, in an embodiment, the above processing parameters further include at least one of the following parameters: a turntable speed $N_w$ of the turntable 310; and a grinding wheel feed rate of the grinding wheel 320.

In an embodiment, each of the grinding parameter combinations may be exemplified as Table 1 below.

TABLE 1

| Grinding parameter combination | |
|---|---|
| Geometric parameter | Processing parameter |
| Radius $R_g$ of the grinding wheel 320 | Grinding speed $N_g$ |
| Radius $R_w$ of the wafer 330 | Turntable speed $N_w$ |
| Eccentric distance DD | Grinding wheel feed rate |
| Inclination angle AN | |

In the embodiment of the invention, the radii $R_g$ and $R_w$ are, for example, fixed values (but the invention is not limited thereto), and different grinding parameter combinations may have different eccentric distance DD, inclination angle AN, grinding speed $N_g$, turntable speed $N_w$ and grinding wheel feed rate.

In step S240, the processor 104 generates multiple grinding simulation result combinations corresponding to the grinding parameter combinations.

In an embodiment of the invention, the processor 104 may substitute each of the grinding parameter combinations into grinding simulation software, and the grinding simulation software outputs/provides the corresponding grinding simulation result combination.

Figure 6:
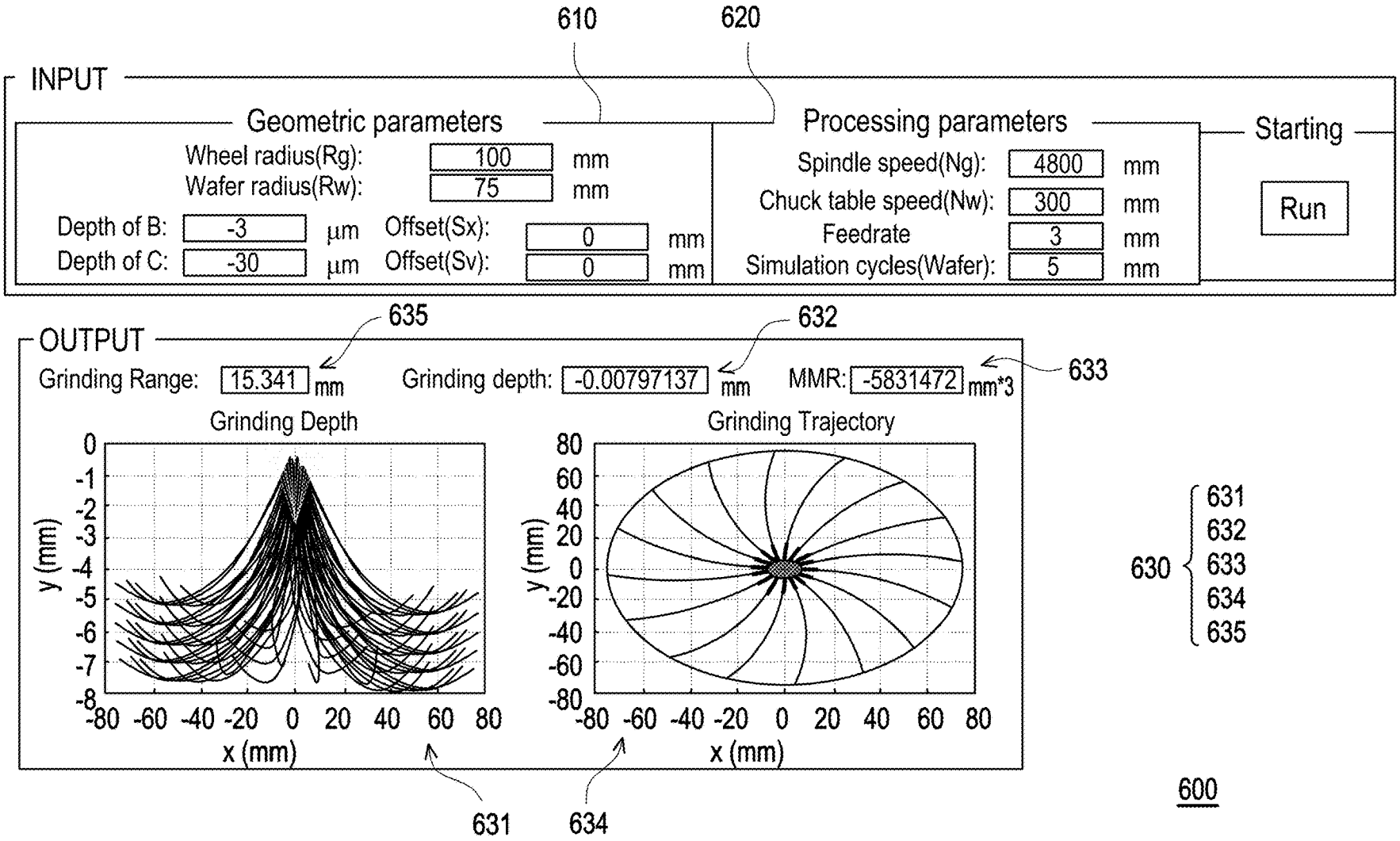
FIG. 6 is a schematic diagram of grinding simulation software according to an embodiment of the invention.

Referring to FIG. 6, FIG. 6 is a schematic diagram of grinding simulation software according to an embodiment of the invention. In grinding simulation software 600 provided by the invention, an input interface 610 may be used to set the geometric parameters of a certain grinding parameter combination (referred to as CM1 hereinafter), and an input interface 620 may be used to set the processing parameters of the grinding parameter combination CM1.

In the situation of FIG. 6, it is assumed that the values of the grinding parameter combination CM1 are shown as Table 2 below.

TABLE 2

| Grinding parameter combination CM1 | |
|---|---|
| Geometric parameter | Processing parameter |
| Radius $R_g$ of the grinding wheel 320 = 100 mm | Grinding speed $N_g$ = 4800 RPM |
| Radius $R_w$ of the wafer 330 = 75 mm | Turntable speed $N_w$ = 300 RPM |
| Eccentric distance DD | Grinding wheel feed rate = 3 μm/s |
| Inclination angle AN | |

Therefore, the corresponding values in the input interfaces 610 and 620 in FIG. 6 may be set according to the content in Table 2. It should be understood that, if it is desired to set the above-mentioned inclination angle AN, the processor 104 may implement it by setting depths of the reference points B and C, for example.

For example, in the situation of FIG. 6, the depths of the reference points B and C are respectively −3 μm and −30 μm, which represents that the heights of the reference points B and C on the wafer processing equipment 300 in FIG. 3 are respectively lowered from a horizontal position by −3 μm and −30 μm (which may be understood as moving −3 μm and −30 μm toward a paper surface in FIG. 3), so as to achieve the required inclination angle AN. In addition, the eccentric distance DD may be realized by adjusting an Offset (Sx) and an Offset (Sy) in the input interface 610, where the values of the Offset (Sx) and the Offset (Sy) may make a center position of the grinding wheel 320 in FIG. 3 to correspondingly move. For example, it is assumed that the Offset (Sx) and the Offset (Sy) are respectively +3 mm and −2 mm, the center position of the grinding wheel 320 in FIG. 3 may be correspondingly moved rightward by 3 mm and downward by 2 mm. For another example, it is assumed that the Offset (Sx) and the Offset (Sy) are respectively −4 mm and +2 mm, the center position of the grinding wheel 320 in FIG. 3 may be correspondingly moved leftward by 4 mm and upward by 2 mm, but the invention is not limited thereto. In the situation of FIG. 6, both of the Offset (Sx) and the Offset (Sy) are assumed to be 0 mm, which represents that the center position of the grinding wheel 320 is maintained at a preset position.

In addition, the processor 104 may also input a simulation cycle length in the input interface 620. In FIG. 6, the simulation cycle length is, for example, 5, i.e., the turntable 310 rotates 5 turns in total, but the invention is not limited thereto.

In an embodiment, the input interfaces 610 and 620 in FIG. 6 may also be manually input by a user, but the invention is not limited thereto.

In an embodiment, after the grinding simulation software 600 of FIG. 6 obtains the required geometric parameters and processing parameters through the input interfaces 610 and 620, it may (be triggered to) perform grinding simulation operations accordingly to provide corresponding grinding simulation result combinations 630.

In an embodiment of the invention, the grinding simulation result combination 630, for example, includes at least one of a grinding depth diagram 631, a grinding range 632, a material removing rate (MRR) 633, a grinding trajectory diagram 634 and a maximum grinding depth 635.

In some embodiments, the above grinding simulation operation may be performed by the grinding simulation software 600 provided by the invention based on a certain algorithm. In an embodiment, the grinding simulation software 600 may perform the above grinding simulation operation based on the content of "Libo Zhou et al., Three-dimensional kinematical analyses for surface grinding of large scale substrate, Precision Engineering, Volume 27, Issue 2, 2003", but the invention is not limited thereto.

Therefore, regarding each of the grinding parameter combinations, the processor 104 may generate the corresponding grinding simulation result combination based on the above teachings.

Thereafter, in step S250, the processor 104 selects a specific grinding parameter combination from the grinding parameter combinations based on each of the grinding simulation result combinations, and sets the wafer processing equipment 300 accordingly.

In an embodiment, the processor 104 may select the one that best meets the requirement from the grinding simulation result combinations, and then use the corresponding grinding parameter combination as the above-mentioned specific grinding parameter combination.

Figure 7:
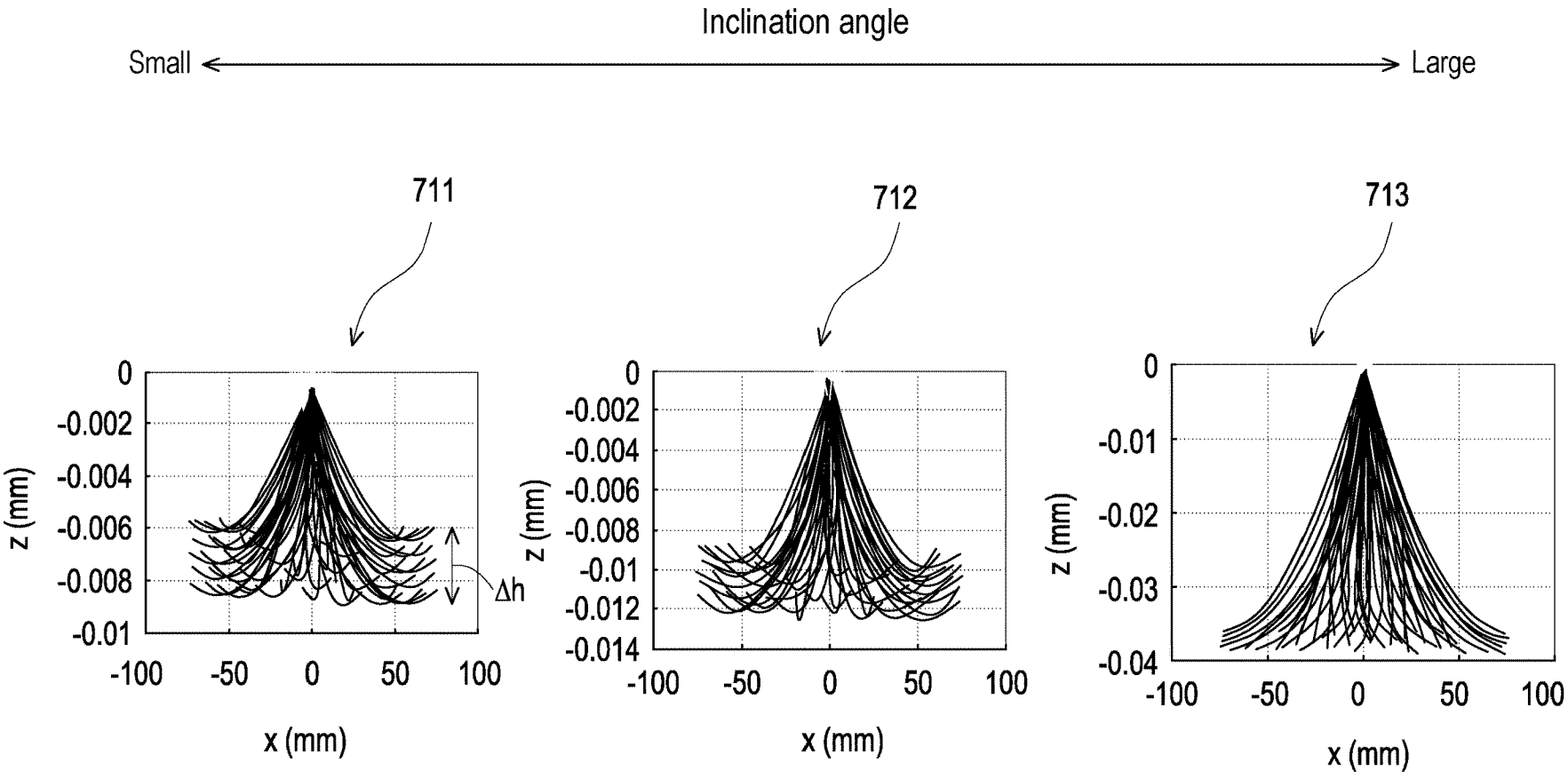
FIG. 7 is grinding depth diagrams corresponding to different grinding parameter combinations according to a first embodiment of the invention.

Referring to FIG. 7, FIG. 7 is grinding depth diagrams corresponding to different grinding parameter combinations according to a first embodiment of the invention. In FIG. 7, grinding depth diagrams 711-713 may respectively correspond to different grinding parameter combinations 1-3. In the embodiment, the grinding parameter combinations 1-3, for example, correspond to different inclination angles AN, but have same grinding speed $N_g$ (for example, 4690 RPM), turntable speed $N_w$ (for example, 300 RPM), grinding wheel feed rate (for example, 3 μm/s) and eccentric distance DD (for example, 0 mm).

In the grinding parameter combination 1, $\varphi_{tx}$=0.01°, $\varphi_{ty}$=0.016°, a depth difference Δh=0.00333 mm, where $\varphi_{tx}$ is an inclination angle in an X direction (i.e., a horizontal direction), and $\varphi_{ty}$ is an inclination angle in a Y direction (i.e., a vertical direction), and the depth difference Δh is a distance between the highest point and the lowest point of a peripheral trajectory. In the grinding parameter combination 2, $\varphi_{tx}$=0.017°, $\varphi_{ty}$=0.027°, the depth difference Δh=0.00372 mm. In the grinding parameter combination 3, $\varphi_{tx}$=0.05°, $\varphi_{ty}$=0.05°, the depth difference Δh=0.00278 mm. In brief, the inclination angles AN corresponding to the grinding parameter combinations 1-3 are incremental.

As shown in FIG. 7, the grinding parameter combination corresponding to the larger inclination angle AN will have a smaller depth difference Δh, i.e., the wafer ground based on the larger inclination angle AN will have better flatness.

Based on the above, for the grinding parameter combinations 1-3, the processor 104 may, for example, select the grinding parameter combination 3 as the specific grinding parameter combination based on FIG. 7, and then set the wafer processing equipment 300 accordingly, but the invention is not limited thereto.

Figure 8:
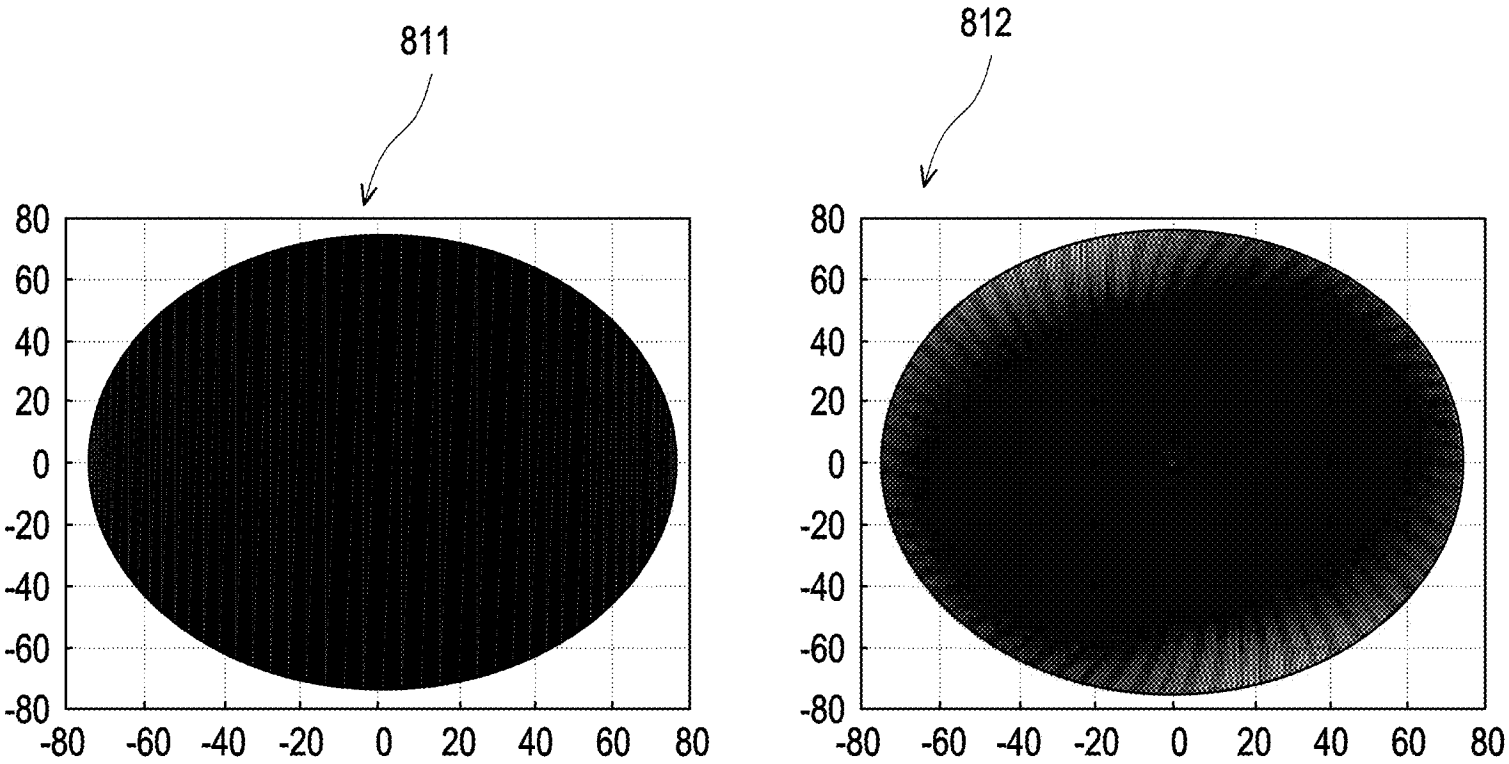
FIG. 8 is grinding trajectory diagrams corresponding to different grinding parameter combinations according to a second embodiment of the invention.

Referring to FIG. 8, FIG. 8 is grinding trajectory diagrams corresponding to different grinding parameter combinations according to a second embodiment of the invention. In FIG. 8, grinding trajectory diagrams 811, 812 may respectively correspond to different grinding parameter combinations 4, 5. In the embodiment, the grinding parameter combinations 4 and 5, for example, correspond to different grinding speeds $N_g$ and turntable speeds $N_w$, but have the same inclination angle AN, grinding wheel feed rate and eccentric distance DD.

In the grinding parameter combination 4, the grinding speed $N_g$ and the turntable speed $N_W$ are, for example, 4800 RPM and 300 RPM, respectively. In the grinding parameter combination 5, the grinding speed $N_g$ and the turntable speed $N_w$ are, for example, 5075 RPM and 227 RPM, respectively. From another point of view, in the grinding parameter combination 4, the grinding speed $N_g$ and the turntable speed $N_w$ are not prime to each other, but in the grinding parameter combination 5, the grinding rotation speed $N_g$ and the turntable rotation speed $N_w$ are prime to each other.

Through simulation, the grinding parameter combination 4 allows the wafer processing equipment 300 to achieve a grinding coverage rate of about 103% in about 100 processing cycles (about 20 seconds). However, the grinding parameter combination 5 allows the wafer processing equipment 300 to achieve a grinding coverage rate of about 97% in only 21 processing cycles (about 5.3 seconds). Namely, the grinding parameter combination 4 takes nearly 4 times longer to achieve a grinding coverage rate similar to that of the grinding parameter combination 5.

Furthermore, in the grinding parameter combination 4, since the grinding speed $N_g$ and the turntable speed $N_W$ are not prime to each other, repeated grinding trajectories are likely to appear, resulting in lower grinding efficiency. Conversely, since the grinding speed $N_g$ and the turntable speed $N_w$ in the grinding parameter combination 5 are relatively prime to each other, repeated grinding trajectories are not easy to occur, resulting in higher grinding efficiency.

Based on the above, for the grinding parameter combinations 4, 5, the processor 104 may, for example, select the grinding parameter combination 5 as a specific grinding parameter combination (which may be understood as including a specific grinding speed and a specific turntable speed that are prime to each other) based on FIG. 8, and then set the wafer processing equipment 300 accordingly, but the invention is not limited thereto.

Referring to FIG. 9A to FIG. 9D, FIG. 9A to FIG. 9D are grinding simulation result combinations corresponding to different grinding parameter combinations according to a third embodiment of the invention. In the third embodiment, FIG. 9A to FIG. 9D, for example, correspond to grinding parameter combinations 6-9, respectively. In the embodiment, the grinding parameter combinations 6-9, for example, correspond to different eccentric distances DD, but have the same grinding speed $N_g$, turntable speed $N_w$, inclination angle AN (for example, $\varphi_{tx}$=0.01°, $\varphi_{ty}$=0.016° and grinding wheel feed rate (for example, 0.3 μm/s).

Figure 9A:
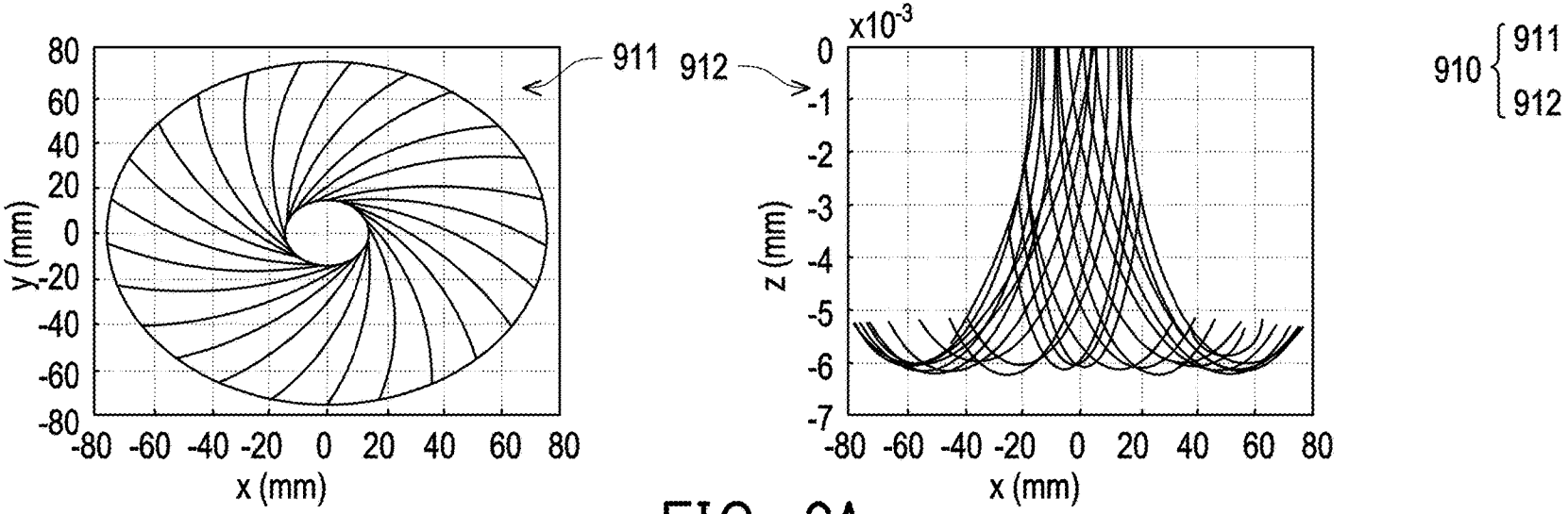
FIG. 9A to FIG. 9D are grinding simulation result combinations corresponding to different grinding parameter combinations according to a third embodiment of the invention.
Figure 9B:
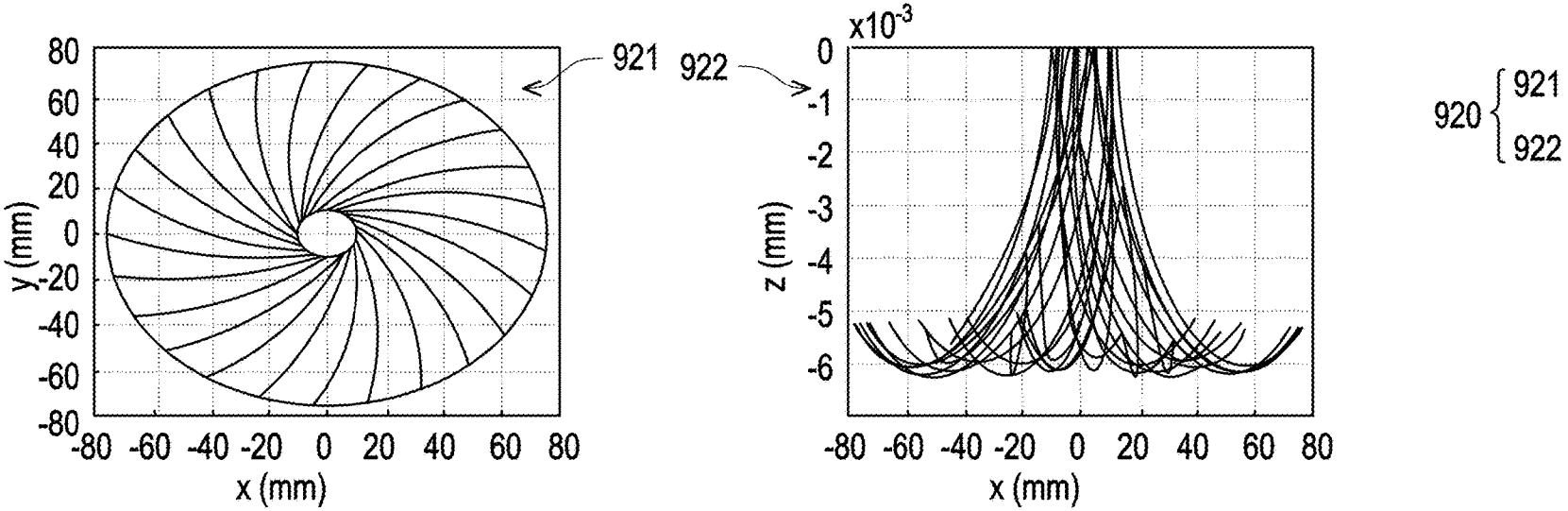
Figure 9C:
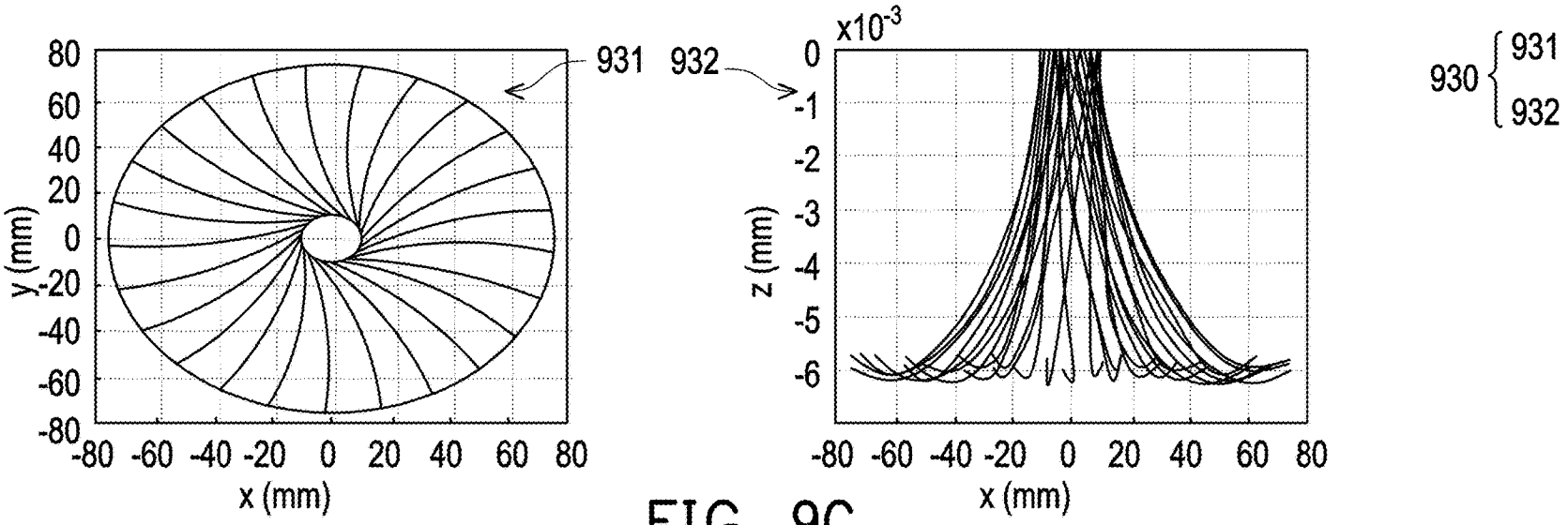
Figure 9D:
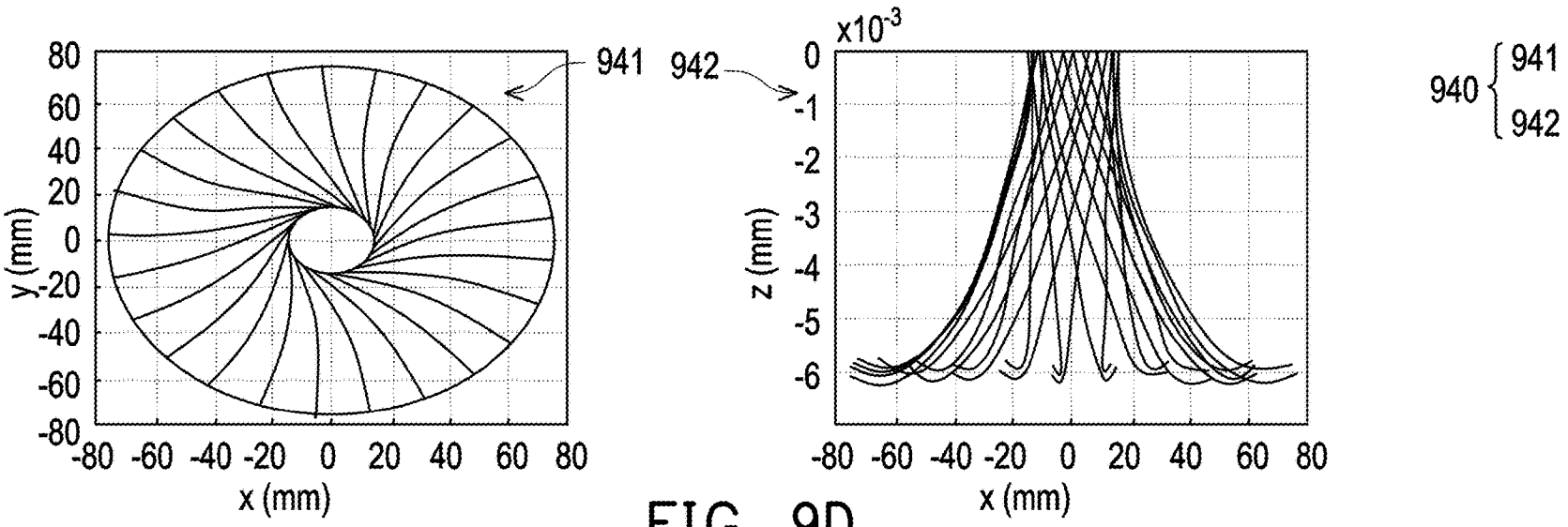

In FIG. 9A, a grinding simulation result combination 910 corresponding to the grinding parameter combination 6 includes, for example, a grinding depth diagram 911 and a grinding trajectory diagram 912. In FIG. 9B, a grinding simulation result combination 920 corresponding to the grinding parameter combination 7 includes, for example, a grinding depth diagram 921 and a grinding trajectory diagram 922. In FIG. 9C, a grinding simulation result combination 930 corresponding to the grinding parameter combination 8 includes, for example, a grinding depth diagram 931 and a grinding trajectory diagram 932. In FIG. 9D, a grinding simulation result combination 940 corresponding to the grinding parameter combination 9 includes, for example, a grinding depth diagram 941 and a grinding trajectory diagram 942.

In the third embodiment, the eccentric distance DD in the grinding parameter combination 6 may be designed so that an edge of the grinding wheel 320 exceeds a center of the turntable 310 (i.e., the edge of the grinding wheel 320 covers the center of the turntable 310 in FIG. 3), and a distance between the edge of the grinding wheel 320 and the center of the turntable 310 is 15 mm. The eccentric distance DD in the grinding parameter combination 7 may be designed so that the edge of the grinding wheel 320 exceeds the center of the turntable 310 (i.e., the edge of the grinding wheel 320 covers the center of the turntable 310 in FIG. 3), and the distance between the edge of the grinding wheel 320 and the center of the turntable 310 is 10 mm. The eccentric distance DD in the grinding parameter combination 8 may be designed so that the edge of the grinding wheel 320 does not exceed the center of the turntable 310 (i.e., the edge of the grinding wheel 320 does not cover the center of the turntable 310 in FIG. 3), and the distance between the edge of the grinding wheel 320 and the center of the turntable 310 is 10 mm. The eccentric distance DD in the grinding parameter combination 9 may be designed so that the edge of the grinding wheel 320 does not exceed the center of the turntable 310 (i.e., the edge of the grinding wheel 320 does not cover the center of the turntable 310 in FIG. 3), and the distance between the edge of the grinding wheel 320 and the center of the turntable 310 is 15 mm.

As shown in FIG. 9A and FIG. 9B, when the edge of the grinding wheel 320 exceeds the center of the turntable 310, the greater the distance between the edge of the grinding wheel 320 and the center of the turntable 310 is, the larger an unground area of the wafer is, and the poorer a surface flatness of the wafer is. As shown in FIG. 9C and FIG. 9D, when the edge of the grinding wheel 320 does not exceed the center of the turntable 310, the greater the distance between the edge of the grinding wheel 320 and the center of the turntable 310 is, the larger the unground area of the wafer is, but the better the surface flatness of the wafer is.

Based on above, for the grinding parameter combinations 6-9, the processor 104 may, for example, select the grinding parameter combination 9 as the specific grinding parameter combination based on FIG. 9, and then set the wafer processing equipment 300 accordingly, but the invention is not limited thereto.

Figure 10:
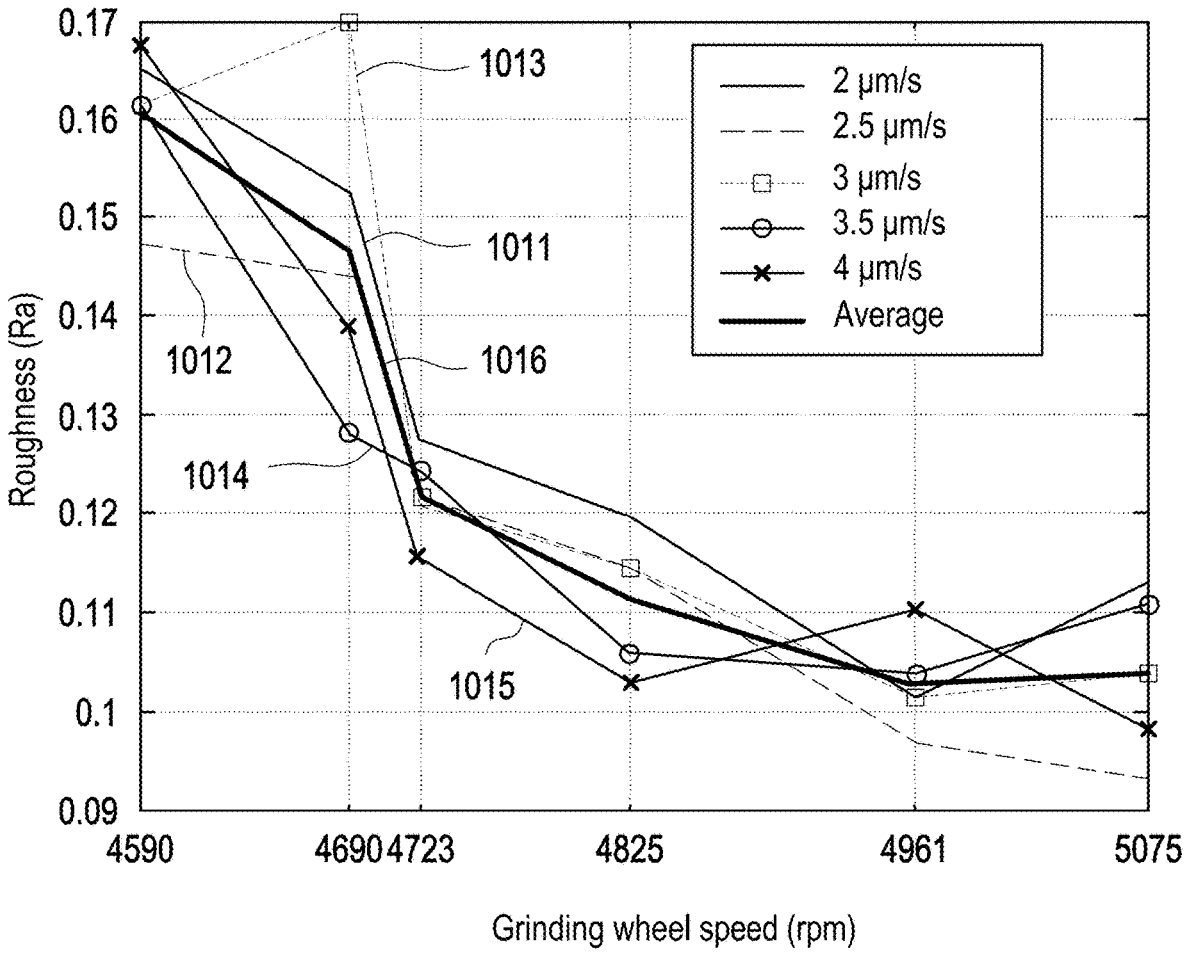
FIG. 10 is a diagram of changes in roughness corresponding to different grinding speeds according to a fourth embodiment of the invention.

Referring to FIG. 10, FIG. 10 is a diagram of changes in roughness corresponding to different grinding speeds according to a fourth embodiment of the invention. In FIG. 10, the grinding wheel feed rates corresponding to curves 1011-1015 are, for example, 2, 2.5, 3, 3.5, and 4 μm/s, respectively, and a curve 1016 is, for example, an average of the curves 1011-1015.

In FIG. 10, values (for example, 4825, 4961, 5075, etc.) shown on a horizontal axis are, for example, the grinding speed considered in the fourth embodiment. It may be seen from the curve 1016 in FIG. 10 that as the grinding speed increases, the roughness of the ground wafer is decreased accordingly. However, when the grinding speed exceeds 4961 RPM, the roughness no longer has a significant downward trend. In other words, in a section where the grinding speed is lower than 4961 RPM, the roughness of the ground wafer may be reduced by increasing the grinding speed.

However, after the grinding speed exceeds 4961 RPM, the roughness of the ground wafer cannot be reduced by increasing the grinding speed. Therefore, instead of selecting a higher grinding speed (for example, 5075 RPM), the processor 104 may select 4961 RPM as the grinding speed based on FIG. 10, but the invention is not limited thereto.

In other embodiments, the processor 104 may pre-provide the grinding simulation result combinations corresponding to each of the grinding parameter combinations to an operator of the wafer processing equipment 300 for reference, so that the operator may find/select the most suitable grinding simulation result combination. Then, the processor 104 may use the grinding simulation result combination found/selected by the operator as the specific grinding parameter combination, and then set the wafer processing equipment 300 accordingly. Based on the above, the wafer 330 processed (for example, ground) by the wafer processing equipment 300 may have characteristics (for example, grinding depth, grinding shape, etc.) that meet the requirements of the operator.

In summary, embodiments of the invention may provide the grinding simulation result combinations corresponding to each of the grinding parameter combinations (including geometric parameters and processing parameters), and determine a specific grinding parameter combination (such as the grinding speed and the turntable speed that are prime to each other, larger inclination angle, larger eccentric distance, etc.) for setting the wafer processing equipment among the grinding parameter combinations. In this way, the wafer obtained by the wafer processing equipment through grinding may have the required characteristics, thereby improving the grinding efficiency and grinding quality (such as a lower roughness) of the wafers. Moreover, through the grinding depth obtained through simulation, the invention may further estimate a service lifespan of the grinding wheel.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A wafer grinding parameter optimization method adapted to an electronic device, comprising:

obtaining a natural frequency of a grinding wheel spindle by controlling an impact hammer to strike the grinding wheel spindle of wafer processing equipment to generate a force signal, collecting the force signal by a force sensor and receiving a vibration signal by an accelerometer, and accordingly generating a grinding stability lobe diagram corresponding to the grinding wheel spindle;

selecting at least one grinding speed from the grinding stability lobe diagram based on a speed range of the grinding wheel spindle;

determining a plurality of grinding parameter combinations based on the at least one grinding speed;

generating a plurality of grinding simulation result combinations corresponding to the grinding parameter combinations;

selecting a specific grinding parameter combination from the grinding parameter combinations based on each of the grinding simulation result combinations, and setting the wafer processing equipment accordingly, wherein the specific grinding parameter combination comprises a specific grinding speed and a specific turntable speed that are prime to each other; and processing a wafer by the wafer processing equipment with the specific grinding parameter combination.

2. The method according to claim 1, wherein obtaining the natural frequency of the grinding wheel spindle comprises:

obtaining the force signal and the vibration signal generated by the grinding wheel spindle after being knocked, and converting the force signal and the vibration signal into the natural frequency of the grinding wheel spindle.

3. The method according to claim 1, wherein each of the grinding parameter combinations comprises at least one geometric parameter and at least one processing parameter, wherein the at least one processing parameter comprises one of the at least one grinding speed.

4. The method according to claim 3, wherein the wafer processing equipment comprises a grinding wheel and a turntable, and the at least one geometric parameter comprises at least one of following parameters:

a radius of the grinding wheel;

a radius of a wafer to be ground;

an eccentric distance of the grinding wheel relative to the turntable; and an inclination angle of the grinding wheel relative to the turntable.

5. The method according to claim 3, wherein the wafer processing equipment comprises a grinding wheel and a turntable, and the at least one processing parameter further comprises at least one of following parameters:

a turntable speed of the turntable; and a grinding wheel feed rate of the grinding wheel.

6. The method according to claim 1, wherein each of the grinding simulation result combinations comprises at least one of a grinding depth diagram, a grinding range, a material removing rate, a grinding trajectory diagram, and a maximum grinding depth.

7. The method according to claim 1, wherein the grinding stability lobe diagram comprises a plurality of peaks, and selecting the at least one grinding speed from the grinding stability lobe diagram based on the speed range of the grinding wheel spindle comprises:

finding a plurality of specific peaks corresponding to the speed range among the peaks, wherein each of the specific peaks corresponds to a specific speed; and determining the at least one grinding speed based on the specific speed corresponding to each of the specific peaks.

8. The method according to claim 7, wherein a difference between each of the grinding speeds and the specific speed corresponding to one of the specific peaks is less than a preset threshold.

9. An electronic device, comprising:

a non-transitory storage circuit storing a program code; and a processor coupled to the non-transitory storage circuit and accessing the program code to:

obtain a natural frequency of a grinding wheel spindle by controlling an impact hammer to strike the grinding wheel spindle of wafer processing equipment to generate a force signal, collect the force signal by a force sensor and receive a vibration signal by an accelerometer, and accordingly generate a grinding stability lobe diagram corresponding to the grinding wheel spindle;

select at least one grinding speed from the grinding stability lobe diagram based on a speed range of the grinding wheel spindle;

determine a plurality of grinding parameter combinations based on the at least one grinding speed;

generate a plurality of grinding simulation result combinations corresponding to the grinding parameter combinations;

select a specific grinding parameter combination from the grinding parameter combinations based on each of the grinding simulation result combinations, and set the wafer processing equipment accordingly, wherein the specific grinding parameter combination comprises a specific grinding speed and a specific turntable speed that are prime to each other; and process a wafer by the wafer processing equipment with the specific grinding parameter combination.

* * * * *